US007434361B1

(12) United States Patent
Taylor

(10) Patent No.: US 7,434,361 B1
(45) Date of Patent: Oct. 14, 2008

(54) DOOR FRAME APPARATUS AND METHOD FOR INSTALLING A DOOR FRAME

(76) Inventor: Robert Taylor, 11313 Trotting Horse La., Jacksonville, FL (US) 32225

( * ) Notice: Subject to any disclaimer, the term of this patent is extended or adjusted under 35 U.S.C. 154(b) by 109 days.

(21) Appl. No.: 10/996,943

(22) Filed: Nov. 24, 2004

(51) Int. Cl.
*E04G 21/04* (2006.01)
*E04H 12/20* (2006.01)
*E04B 1/00* (2006.01)

(52) U.S. Cl. ..... 52/127.2; 52/146; 52/745.15; 269/905

(58) Field of Classification Search ..... 52/749.1, 52/745.15, 146, 127.2; 269/904, 905; 248/351, 248/354.1
See application file for complete search history.

(56) References Cited

U.S. PATENT DOCUMENTS 2,914,813 A 12/1959 Christian
3,199,206 A * 8/1965 Snapp ..... 33/194
3,648,421 A * 3/1972 Bjork ..... 52/99
4,048,771 A * 9/1977 Thistlethwaite ..... 52/127.2
4,304,078 A * 12/1981 Meriwether, Jr. ..... 52/127.2
4,872,634 A * 10/1989 Gillaspy et al. ..... 248/354.3
5,025,607 A * 6/1991 Green et al. ..... 52/749.1
5,114,127 A * 5/1992 Everhart ..... 269/41
5,253,839 A 10/1993 McClure
5,377,462 A * 1/1995 Beals et al. ..... 52/127.2
5,704,171 A * 1/1998 Ruff et al. ..... 52/127.2
6,234,440 B1 * 5/2001 Boney et al. ..... 248/354.1
6,357,200 B1 3/2002 Vanderpan
6,976,339 B1 * 12/2005 Riccio et al. ..... 52/127.1

* cited by examiner

*Primary Examiner*—Robert Canfield
*Assistant Examiner*—Ryan D. Kwiecinski
(74) *Attorney, Agent, or Firm*—Lawrence J. Gibney

(57) ABSTRACT

In order to correctly align a door in a doorway structure, this device has been contemplated. It will be comprised of several identically shaped members that extend from the top of the door jamb to another separate member that is secured to the floor. The use of dual members that extend from the door jamb to the floor aligns the door in one dimension in the doorway but in order to align the door from the side a separate side member will be used.

10 Claims, 4 Drawing Sheets

DOOR FRAME APPARATUS AND METHOD FOR INSTALLING A DOOR FRAME

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to installing a door frame so that is aligned within the space in all planes and also the method for framing the door.

B. Prior Art

One of the difficulties when framing a door is to ensure that it is true, level and plumb in all directions. This includes being true and plumb in all planes. If the door is not framed correctly initially, it will not close properly when the surrounding structure is complete.

The usual method to install a door is to first position a piece of wood on the concrete floor. A piece of lumber is then extended from this floor piece to the doorjamb. Often times there are two or more pieces of wood on the floor. The problem with this arrangement is that if the worker does not measure the distance from the door to the placement point correctly and the pieces are at different distances, even slightly different distances, from the lower edge of the door frame, the door will not install correctly.

However, because of incorrect measurements or inconsistent methods of attaching to the floor, this may produce a door frame which does not allow the door to sit in a finished frame properly.

The prior art has tried to address the problem of incorrect framing of a door frame and representative examples of the prior art include Ruff, U.S. Pat. No. 5,704,171, Thistlewaite, U.S. Pat. No. 4,048,771 and Meriwether, U.S. Pat. No. 4,304,078.

However, in order to truly install a door frame, which is square relative to the entry as well as relative to the supporting structure, this device has been developed.

None of the prior art examples address framing the door in all dimensions and all planes. Additionally, the method of installation in the other devices is substantially different than the method of truly aligning the door within the space as contemplated by this device.

BRIEF SUMMARY OF THE INVENTION

This device consists of two parallel support members, which extend outward and downward from the top of the door jamb to the floor. The two support members are parallel to each other when installed and are attached to the top of the doorframe by slots in the top framing brackets. The two support members are equal in length. The framing brackets are installed on the doorjamb and are identical in shape and size. The top framing members are secured in place to the door jamb by a screw or nail.

The two by four extension members are placed within a slot of the framing brackets and extend to the foot brackets, which are secured to the floor with a screw or nail.

The extension members are then inserted into the foot brackets. The foot brackets are identical to each other and stops are inserted within the foot brackets to ensure uniform placement of the extension members within the device. Stops are also placed in the two top framing brackets to maintain position of the extension members within the framing members and foot brackets and to prevent slippage.

Because of the identical dimensions of the foot brackets, framing brackets and extension members, uniform placement of the door within the frame itself is achieved.

Additionally, there is a side member, which is attached to a separate side foot bracket and extends from the side foot bracket to the side of the door. One end of the side member is inserted within a slot in the side foot bracket and uses the existing hinge holes of the door frame to secure the side member to the door frame.

The use of the two extension members and the side member together ensures the true fit of the door frame in all planes.

Only one side member is necessary for proper installation although more than one can be used.

The method of installing a door frame must be kept simple and uniform in order to produce uniform results. This device accomplishes that object with minimal room for human error.

DETAILED DESCRIPTION OF THE EMBODIMENTS

Figure 1:
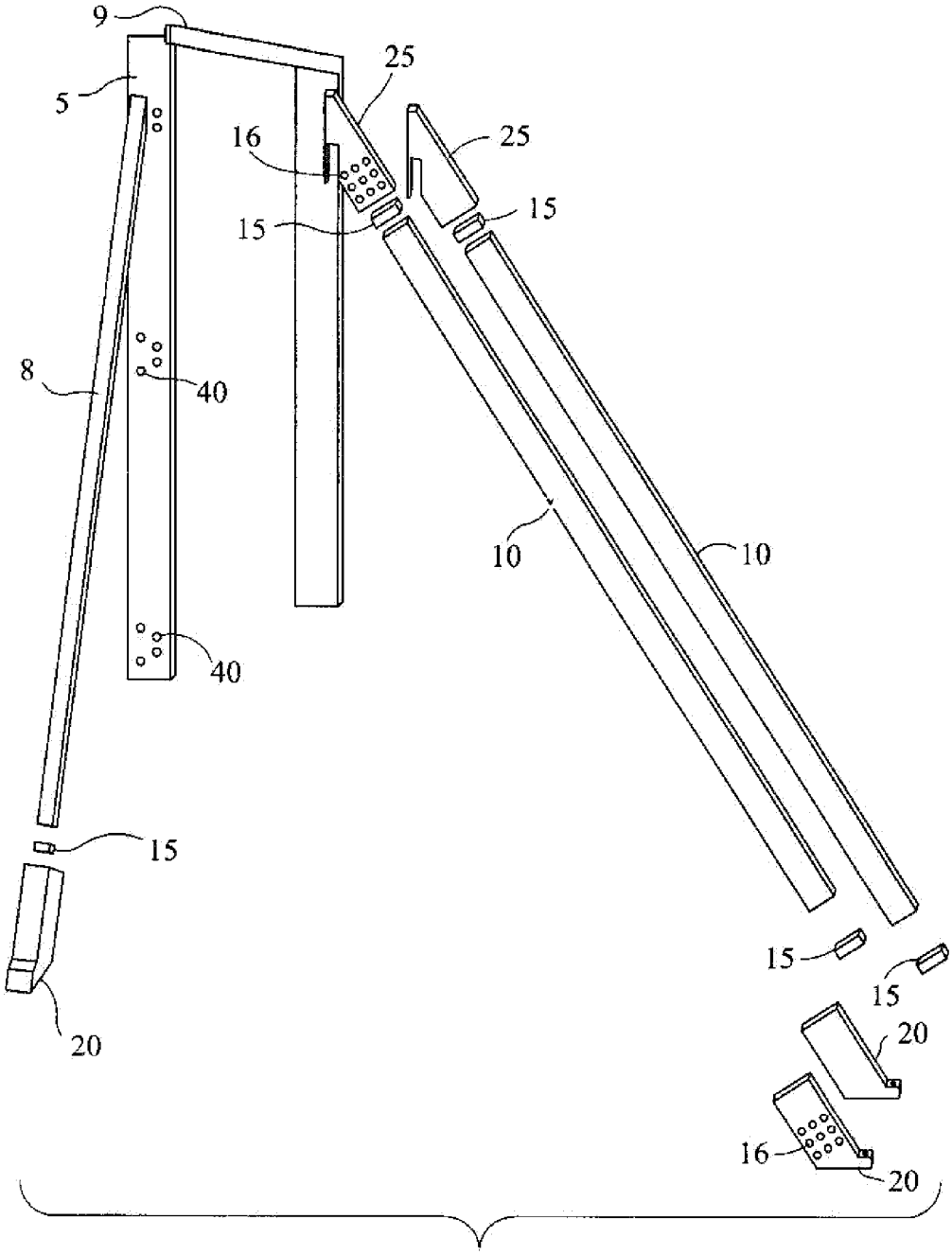
FIG. 1 is an exploded view of the device.

One of the objects of this device is to ensure that a door is framed within the door opening in all planes. This device will accomplish that result with relative ease and with unique simplicity.

When this device is used, a door will be frames correctly in all planes. The device can be easily picked up and transported to the next door or the next job site. It will be constructed of durable material such as fiberglass re-enforced plastic (FRP). It is not anticipated that metal will be used because metal is corrosive and heavy.

Additionally, fiberglass is probably the preferred material because of its lightweight and durable characteristics in addition to its relatively low cost.

This device is comprised of two identically shaped top framing brackets 25, each of the top framing brackets is attached via a slot or opening in the top framing bracket 25 to the top of a door frame 5, three foot brackets 20, which also have a slot or opening for the respective extension member, two extension members 10 and a side support member 8.

The framing brackets 25 are identical as far as shape, configuration and dimension to each other. Likewise, the foot brackets are identical as far as shape, configuration and dimensions. The two extension members 10 are identical in shape and length. The side member 8 may or may not be identical to the extension member 10 but has the same general shape.

Both top framing brackets 25 will be installed over the lip 9 on the door frame 5 and both framing brackets 25 have an opening 7 to insert the extension member 10, which extends from one side of the framing bracket 25 to the foot bracket 20 which has been placed on the ground.

Figure 1A:
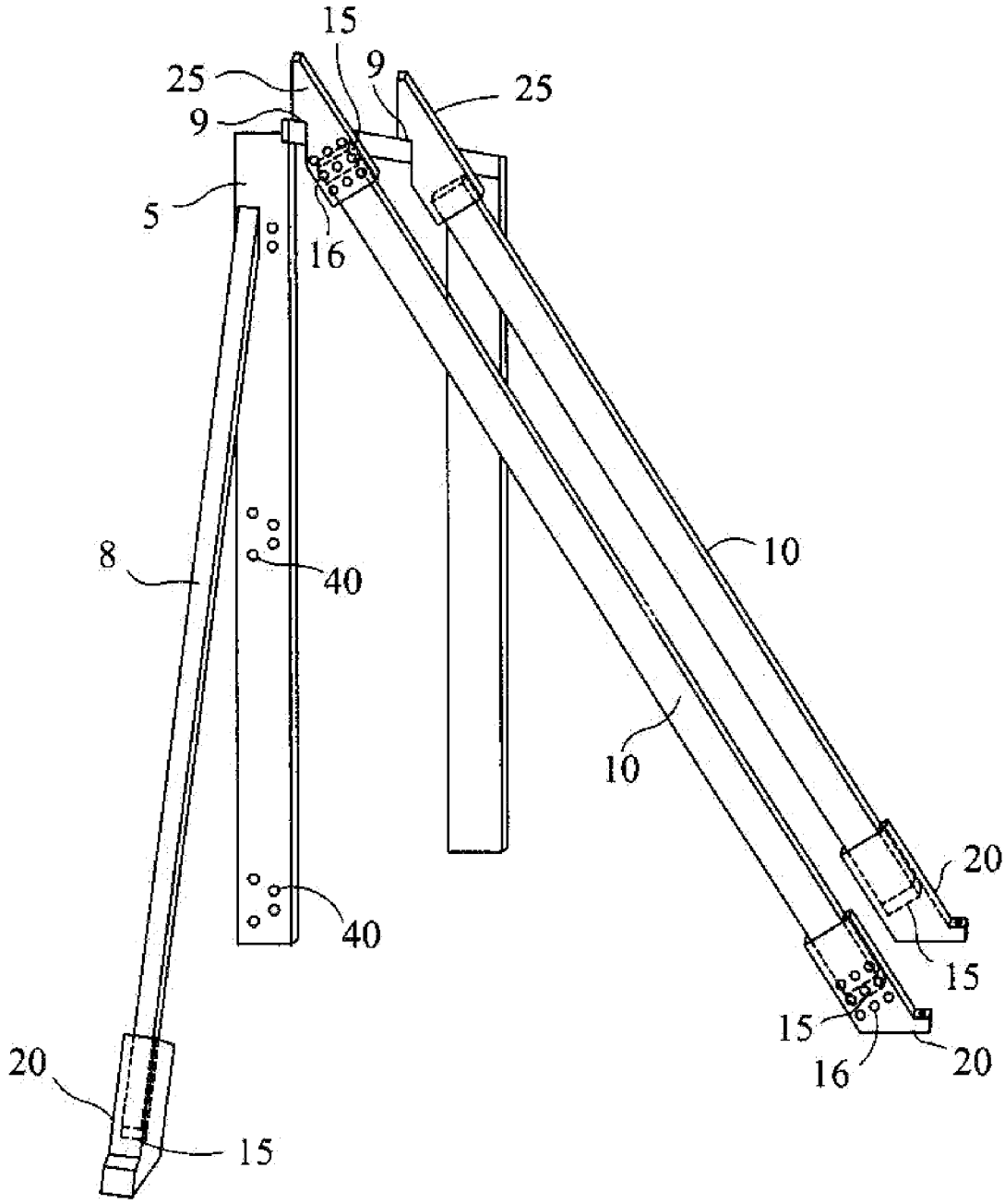
FIG. 1A is the device installed on a doorframe.
Figure 2:
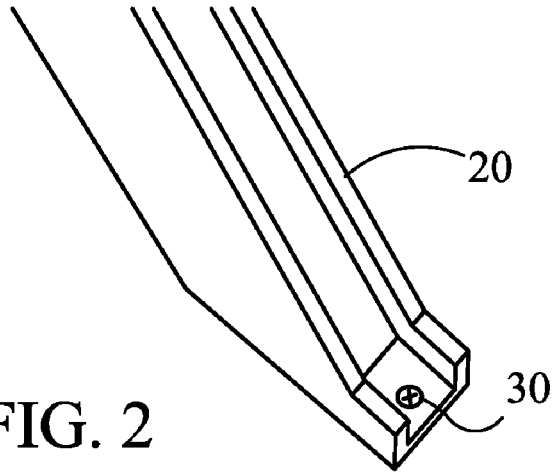
FIG. 2 is a partial view of the foot bracket installed on the ground.
Figure 3:
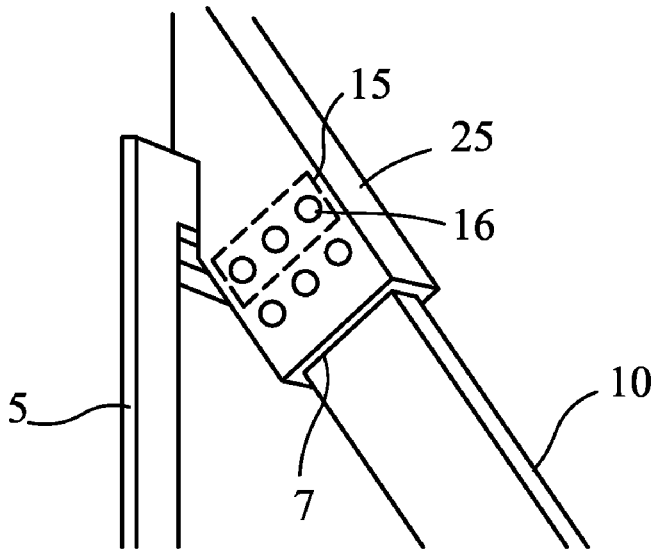
FIG. 3 is the top framing bracket installed over the door jamb.

Holes 16 are placed in the framing brackets through which a means to secure the framing bracket 25 to the extension member 10 is provided. There are several parallel rows of holes such as depicted in FIGS. 1 and 1A through which the means to secure the framing member are provided. The means to secure may be a screw or nail or many other devices that are commonly found in the prior art.

In order to make sure that the framing bracket does not come off the lip of the door jamb a means to secure 30A the framing bracket 25 to the top of door jamb is provided. This means to secure may be a screw or nail.

The extension members 10, which extend from the doorjamb to the foot bracket 20, are identical in length.

Figure 4:
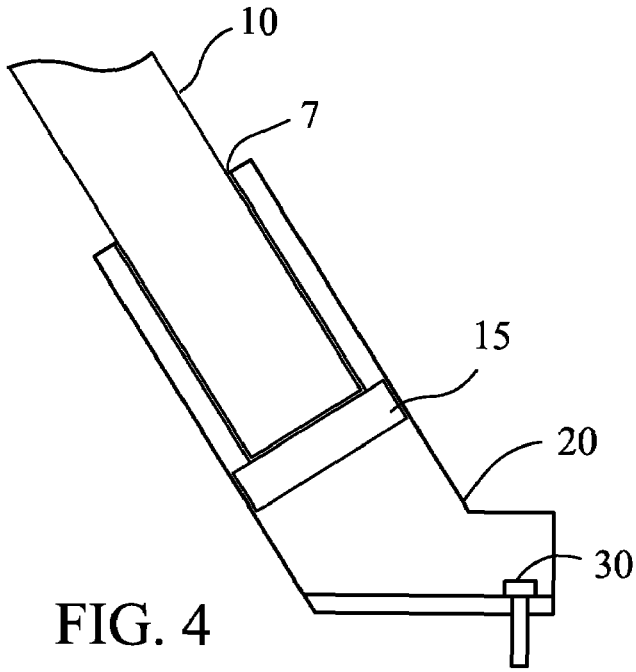
FIG. 4 is a cross section of foot bracket depicting the stop mechanism.
Figure 5:
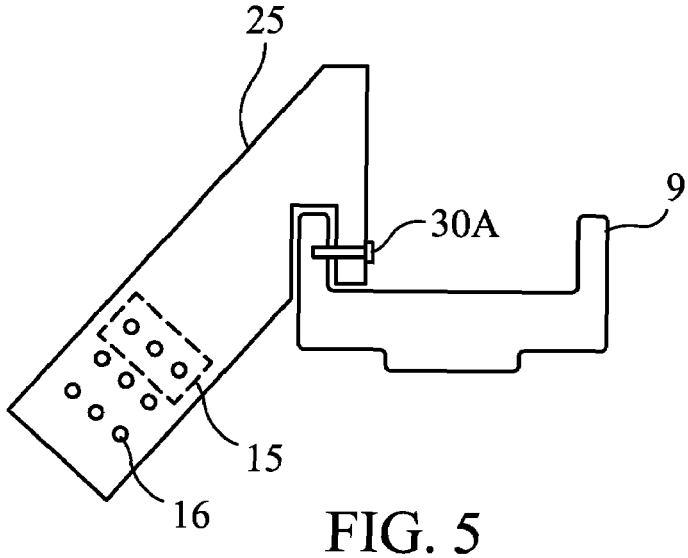
FIG. 5 is a view of the top of the framing member secured to the door jamb.

The framing brackets 25 and foot brackets 20 are equipped with a stop mechanism 15 within the device as depicted in FIG. 4 to ensure that the length being used is uniform relative to each particular member.

The extension members 10 are inserted into the opening 7 that is provided in the framing bracket 25 and extends to the opening 7, which is provided in the foot bracket 20. The foot bracket 20 provides the anchor of this device and is installed using a screw 30 which is inserted through a hole in the foot bracket 20 and into the floor structure. The floor structure will probably be concrete. The foot bracket 20 with extension members 10 and framing bracket 25 secures the device to the door frame 5 and secures the device in one plane.

The foot brackets 20 themselves also have identical dimensions and include a stop mechanism 15, which is designed into the interior of the foot bracket 20 to ensure that the extension members extend the same length into the foot bracket 20.

No measurement is needed from the framing bracket 25 to the foot bracket 20 because the length of the extension members 10 are identical and dictate the placement of the foot bracket 20. The worker at the job site does not need to measure the distance from the bottom of the door frame 5 to the placement of foot bracket 20. In the old method an incorrect measurement from the bottom of the door frame 5 to the foot bracket 20 will produce an incorrect installation of the door.

Because no such measurement is necessary with this device and because of the uniform lengths of the extension members 10, this device will eliminate one area of possible mistake in installation.

Additionally, in order to ensure that the frame 5 is completely square relative to the supporting structure a side member 8 is installed using a similar foot bracket 20, which is placed and secured to the floor. Again, the foot bracket 20 on the side is installed in a similar manner and has a similar slot into which a side extension member 8 is inserted. A stop mechanism 15 is placed within this side foot bracket. The side extension member 8 extends from the slot in the foot bracket 20 to an existing hinge hole in the door frame 5 itself. The foot bracket is secured using a screw and the opposite end of the side member is secured to the door frame using a screw through the existing hinge hole in the door. This ensures that the door is installed correctly in that plane.

Due to the fact that there are methods to secure the device in all the planes, this provides a tight and secure fit to the device in the door frame 5.

The worker at the job site would use three foot brackets 20 and install them into the flooring using an appropriate securing mechanism, probably a screw 30. Two extension members would extend from the respective to the foot bracket 20 to the respective framing bracket 25, which has been placed over the lip of the door frame. The worker would then install the side member 8 using similar steps. Because it is important to insure that the door frame 5 is installed correctly in one plane two extension members 10 should be used.

Because of its simplicity there is very little room for error in terms of measurement. Because of its durability, there is very little chance of damaging the unit.

While the embodiments of the invention have been disclosed, certain modifications may be made by those skilled in the art to modify the invention without departing from the spirit of the invention.

The invention claimed is:

1. A device to install a door frame assembly, which is comprised of:

a. two top framing brackets;

b. three foot brackets;

said foot brackets secure one end of a plurality of extension members to the flooring;

c. three extension members;

wherein two of said extension members extend outward and downward from the top of the door frame to the ground;

wherein the third of said extension members extend from the side of the door frame to the ground;

d. means to attach the foot brackets to the flooring;

wherein the top framing brackets are placed over a lip of the top of a door frame;

wherein a means to secure the top framing bracket to the top of the door frame is provided;

wherein a means to secure one end of the extension member to the top framing bracket is provided;

wherein the top framing brackets are identical in shape and dimension and a slot is provided;

said slot is inserted over the lip on the top of the door frame;

said foot brackets are secured to the flooring;

wherein two extension members are of equal length and are installed in slots provided in the framing brackets and the foot brackets;

said two extension members extend from the top of the door frame to the foot brackets;

a means of attachment to secure the extension members to the foot brackets is provided.

2. The device as described in claim 1 wherein a stop mechanism is placed within the foot brackets.

3. The device as described in claim 1 wherein a stop mechanism is placed within the top framing brackets.

4. The device as described in claim 1, wherein one of the extension members extends from the side foot bracket to existing hinge holes of the door frame.

5. The device as described in claim 1 wherein the means to secure the extension members to the top framing bracket is a nail.

6. The device as described in claim 1 wherein the means to secure the extension members to the top framing bracket is a screw.

7. The device as described in claim 1 wherein the means to secure the extension members to the foot bracket is a nail.

8. The device as described in claim 1 wherein the means to secure the extension members to the foot bracket is a screw.

9. The device as described in claim 1 wherein the means to secure the top framing bracket to the top of the door frame is a nail.

10. The device as described in claim 1 wherein the means to secure the top framing bracket to the top of the door frame is a screw.

* * * * *